US007470842B2

(12) United States Patent
Miller

(10) Patent No.: US 7,470,842 B2
(45) Date of Patent: Dec. 30, 2008

(54) MUSICAL INSTRUMENT CRADLE

(76) Inventor: Matthew K. Miller, 6816 Olentangy River Rd., Delaware, OH (US) 43015

( * ) Notice: Subject to any disclaimer, the term of this patent is extended or adjusted under 35 U.S.C. 154(b) by 237 days.

(21) Appl. No.: 11/157,368

(22) Filed: Jun. 21, 2005

(65) Prior Publication Data

US 2006/0005688 A1 Jan. 12, 2006

Related U.S. Application Data

(60) Provisional application No. 60/586,905, filed on Jul. 9, 2004.

(51) Int. Cl.
*G10D 3/00* (2006.01)

(52) U.S. Cl. ..... 84/329

(58) Field of Classification Search ..... 84/327, 84/329

See application file for complete search history.

(56) References Cited

U.S. PATENT DOCUMENTS

| | | | | |
|---|---|---|---|---|
| 2,884,173 | A | 3/1956 | Campbell et al. | |
| 3,214,072 | A | 11/1963 | Brown | |
| 3,323,698 | A * | 6/1967 | Sottile | 224/264 |
| 4,251,016 | A | 2/1981 | O'Rafferty et al. | |
| 4,279,367 | A * | 7/1981 | Jacobs | 224/257 |
| 4,291,822 | A | 9/1981 | Simonds | |
| 4,553,780 | A | 11/1985 | Strachan | |
| 4,858,801 | A | 8/1989 | Sameniego | |
| 5,437,401 | A | 8/1995 | Seltzer | |
| 5,642,842 | A * | 7/1997 | Taras | 224/250 |
| 5,732,861 | A * | 3/1998 | Jakobson | 224/160 |
| 5,833,292 | A | 11/1998 | Lyons | |
| 6,182,875 | B1 | 2/2001 | Fareghi | |
| 6,359,203 | B1 | 3/2002 | Cronos | |
| 6,581,812 | B2 | 6/2003 | Roscoe-Dare | |
| 6,590,145 | B2 | 7/2003 | Doiron | |
| D479,554 | S | 9/2003 | Boron et al. | |

FOREIGN PATENT DOCUMENTS

| | | | |
|---|---|---|---|
| DE | 3719995 | A1 * | 1/1988 |
| JP | 10171448 | | 6/1998 |

* cited by examiner

*Primary Examiner*—Kimberly R Lockett
(74) *Attorney, Agent, or Firm*—Mueller Smith

(57) ABSTRACT

The present invention is addressed to a cradle for a musical instrument, which consists of a support having a figure-8 configuration including a pair of loops adapted to support the musical instrument without the use of any fastening device. The cradle also consists of a strap having a pair of ends, each of which is connected to a loop of the support. A buckle may be provided to adjust the length of the strap. In use, a musical instrument is positioned in the inventive cradle with the loops supporting the instrument. The strap is secured about a user so that the musical instrument is supported in a substantially horizontal position by the loops. Thereafter, the instrument is removed by lifted the instrument from the support.

9 Claims, 4 Drawing Sheets

MUSICAL INSTRUMENT CRADLE

CROSS-REFERENCE TO RELATED APPLICATIONS

This application claims benefit of U.S. Provisional Application Ser. No. 60/586,905 filed Jul. 7, 2004.

STATEMENT REGARDING FEDERALLY SPONSORED RESEARCH

Not applicable.

BACKGROUND OF THE INVENTION

The present invention relates to an improved cradle for use with a guitar or other similar musical instrument. More particularly, the invention relates to a cradle which supports a guitar or other musical instrument without the use of pegs, screws, or other fastening devices.

Modern music is made with a plethora of stringed instruments in a variety of performance genres, from orchestras to rock bands to folk music. These instruments vary in size, shape, sound, string configuration, etc. The present invention is designed to be used with those stringed instruments which the player holds in a generally horizontally position and plays by plucking the strings. Chief among such instruments is the guitar. Although its history and development is somewhat uncertain, it is believed that the guitar first appeared in 12th century Spain. Modern variations include the classical, arch-top, steel string, and electric guitars. Other similar instruments include the banjo, ukulele, and the like.

When playing a guitar or other similar instrument, it is customary for the instrument to be supported by a strap which is positioned, for example, over the shoulder or neck of the player and attached to at least one end of the body of the instrument. The strap typically is comprised of leather, fabric or similar material, and includes an end portion or end tab including a hole or other opening therein which fits or slides over a screw, peg, or other fastening device affixed to the instrument neck and/or body to hold the strap in place. However, in order to mount the guitar strap in this manner, one must drive a screw or other fastening device through the body of the instrument, leaving a permanent hole in the instrument and possibly damaging the instrument. See, for example, U.S. Pat. Nos. 6,359,203 and 4,279,367.

Recognizing this problem, the art has conceived of a strap for supporting a musical instrument without a screw, peg, or other fastening device affixed to the instrument neck and/or body to hold the strap in place. U.S. Pat. No. 4,251,016 discloses such a harness for a guitar. The harness is configured such that it tightly encloses the instrument without modifying or penetrating the instrument. The harness includes a series of straps, 22, and connecting members, 20 and 44. A neck strap is attached to the connecting members 20 and 44 by means of a pair of hook receptacles 26 and 50. The length of straps 22 may be adjusted to accommodate different size instruments via buckles 46. Although this harness accomplishes the purpose of supporting a guitar without altering the guitar's structure, its complicated configuration makes securing and removing the guitar a time consuming and involved process.

Japanese abstract JP 10171448 discloses a similar harness configuration for a hard case used to transport a musical instrument. The harness is adjustable at 1*a-b*, 2*a-b*, to permit carrying straps 5 to be affixed to the case in different configurations, thus, enabling the user to carry the case in different positions, i.e., over the shoulder, on the back, etc.

BRIEF SUMMARY OF THE INVENTION

The present invention provides a simple and elegant solution for effectively supporting a guitar or other musical instrument while avoiding the requirement for a fastening device to be driven into the guitar body.

According to one aspect of the present invention, a musical instrument cradle is provided which consists essentially of a support having a figure-8 configuration comprising a pair of loops and a strap having a pair of ends, each of which is connected to a loop of the support. The cradle consists of these elements and these elements only. With this configuration, a musical instrument may be mounted on the cradle without the use of a fastening device. By "fastening device", it is meant any device which penetrates the heel or body of the guitar. This phrase also includes any additional strap segments which extend about the musical instrument to retain it within the cradle. The strap may rest about the shoulder, neck or waist of the user and may include a buckle for adjusting the length of the strap.

The figure-8 configuration of the support cradles the musical instrument and allows the user to quickly and easily mount and remove the musical instrument from the cradle. Thus, there is no need to modify the body of the guitar to mount the strap or to provide a hole or other tap in the strap for attachment to the musical instrument. There also is no need to provide additional straps, as described in connection with the prior art, that extend about the musical instrument to retain it in the strap.

BRIEF DESCRIPTION OF THE DRAWINGS

For a fuller understanding of the nature and advantages of the present invention, reference should be had to the following detailed description taken in connection with the accompanying drawings, in which.

DETAILED DESCRIPTION OF THE INVENTION

Figure 1:
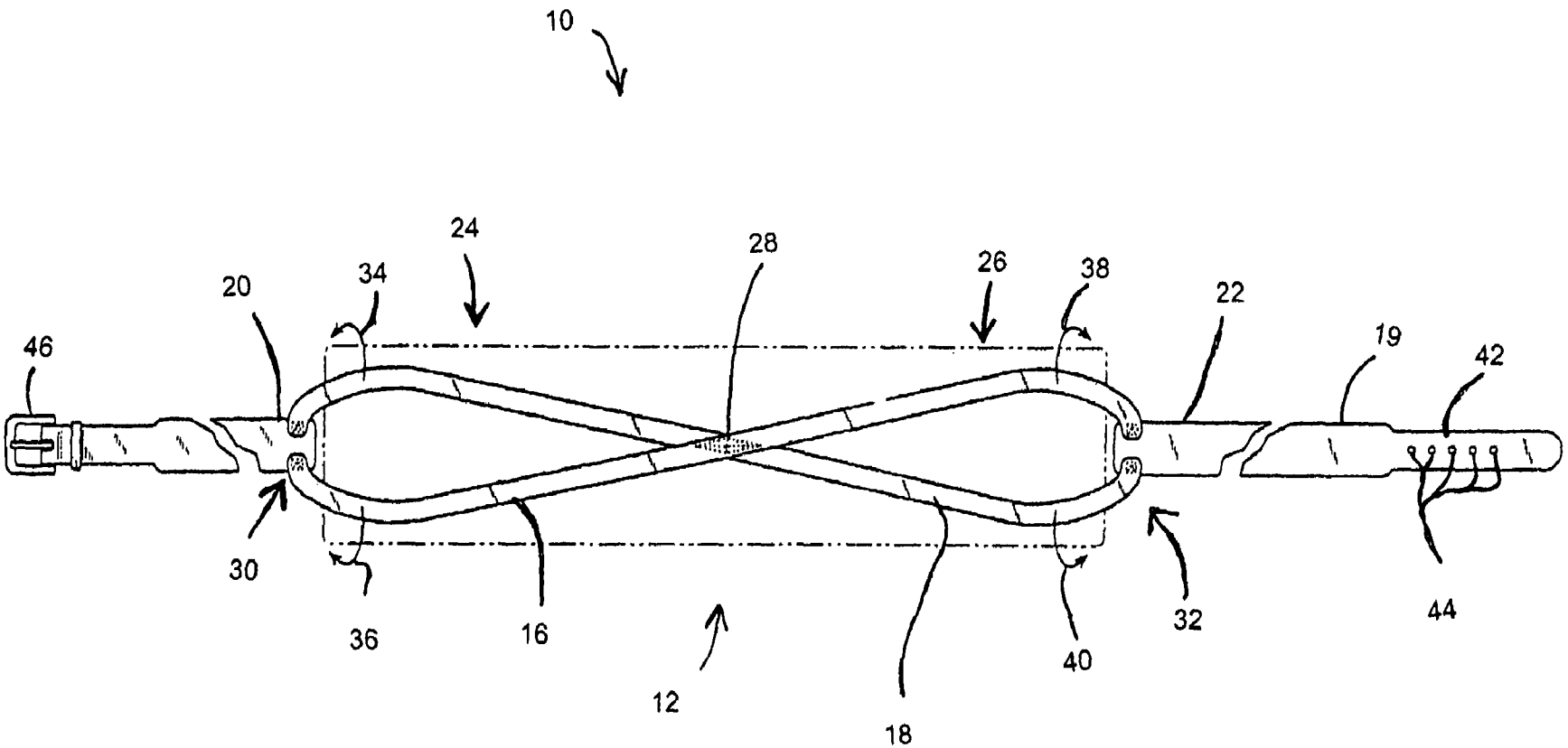
FIG. 1 is a perspective view of the musical instrument cradle of the present invention.

Turning initially to FIG. 1, the musical instrument cradle, 10, includes a support, 12, for supporting a musical instrument and a strap, 14 (FIG. 2), for securing the cradle about a user. Support 12 has a figure-8 configuration and includes a pair of flexible, linear bands, 16 and 18, which form a pair of loops, 24 and 26, and are attached at their midpoints or intersection, 28. Instead of a pair of bands, support 12 may be formed from a single band that is twisted as illustrated by arrows 34, 36, 38, and 40 to form the desired figure-8 configuration. Alternatively, loops 24 and 26 may be circular bands releasably or permanently joined together to form the figure-8. If loops 24 and 26 provided as circular bands, their relative sizes may be the same or different.

Support 12 may be comprised of any soft, flexible material, such as leather, fabric, plastic, or the like, or a combination thereof. Preventing damage to a musical instrument is always important, but it is especially important when the instrument is a classic or collector's item. Selecting a soft material prevents scratching, abrasion, or other structural damage of the musical instrument. The flexibility of the material enables the support to conform to the shape of the musical instrument and facilitates the insertion and removal of the instrument from cradle 10.

Figure 2:
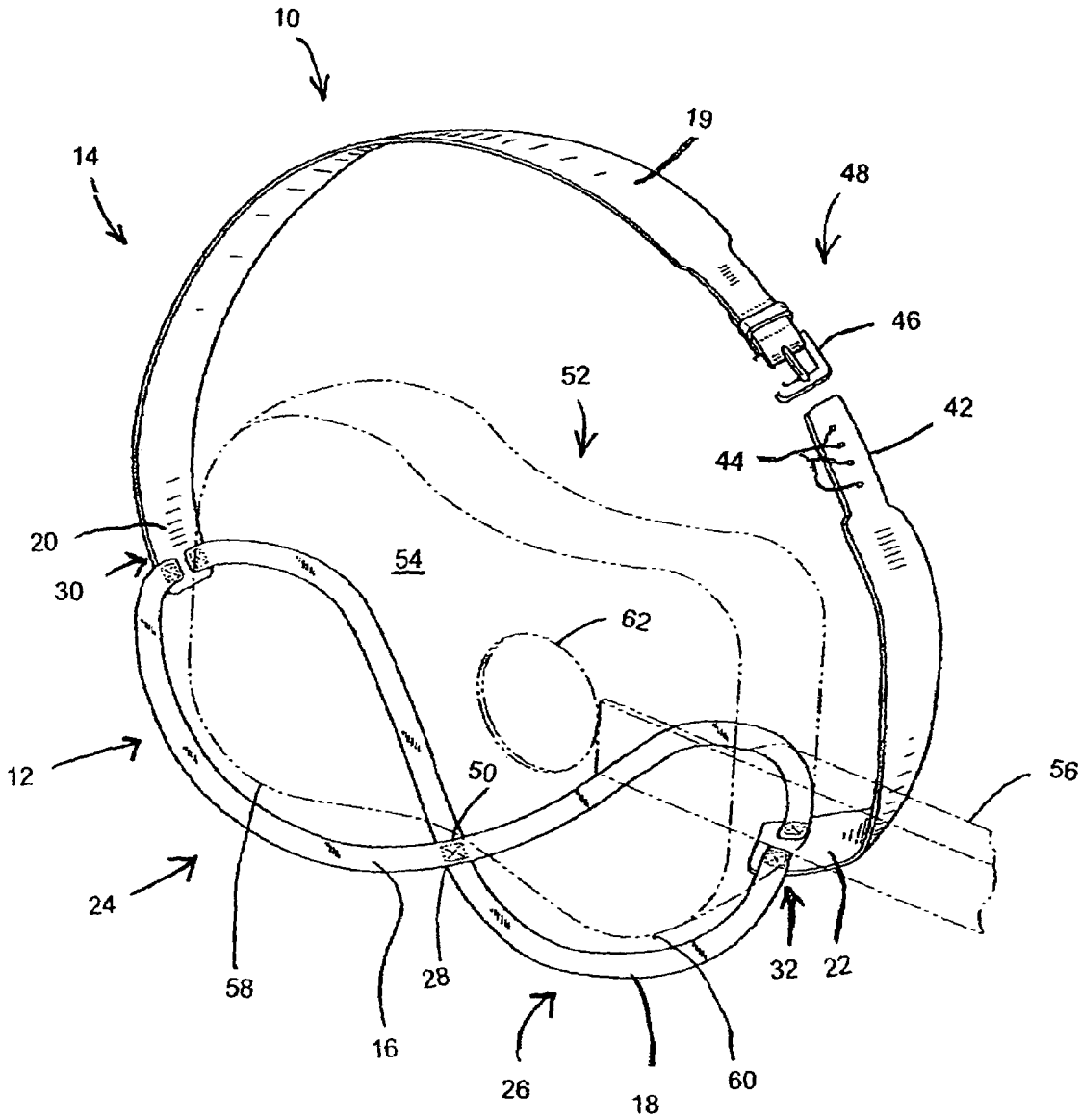
FIG. 2 is a perspective view illustrating attachment of the musical instrument cradle to a guitar, which is shown in phantom.

In FIG. 1, bands 16 and 18 are stitched together at intersection 28 so that the size of loops 24 and 26 are fixed. For this fixed embodiment, the angle between the bands on either side of intersection 28 also will be fixed. This angle is identified in FIG. 1 as $\alpha$. This embodiment may be preferred when cradle 10 will be used with a single musical instrument of a given body shape. When cradle 10 is intended to be used with instruments of varying body shapes, adjustability of the loop sizes may be preferred. This is achieved, for example as shown in FIG. 2, by providing one of the bands with an elongate slot at intersection 28. The other band then is threaded through the elongate slot and slides freely back and forth to determine the relative size of loops 24 and 26. In FIG. 2, band 16 of cradle 10 has been provided with an elongate slot 50. Band 18 extends through slot 50. By elongating the slot, the bands may be pivoted with respect to one another, which changes the angle $\alpha$ between the bands and, thus, changes the geometrical configuration of loops 24 and 26. Once the bands have been adjusted, the instrument will be positioned therein and the weight of the instrument will retain the bands in the desired configuration.

In FIG. 2, strap 14 includes a linear band, 19, having first end, 20, and second end, 22, which are connected to support 12. In the embodiment shown, bands 16 and 18 are secured to first end 20 and second end 22, for example, by stitching, as indicated generally at 30 and 32; however, the connection of the support 12 and strap 14 may be by any other suitable connecting means. Support 12 and strap 14 may be permanently connected together as shown, or, alternatively, may be releasably connected together by any conventional means, such as snaps, buckles, Velcro®, etc. If desired, the support and strap may be integrally formed.

Strap 14 extends between first end 20 and second end 22 and includes an optional adjustment mechanism, 48, which allows the length of strap 14 to be adjusted for an individual user. Adjustment mechanism 48 may be in the form of a belt-type buckle, as shown in FIG. 1, which includes a detachable portion 42 including notches 44 therein which mates with a buckle 46. Alternatively, the strap may be slideably threaded through a buckle and the length adjusted without the use of notches. Instead of a buckle, other conventional mechanisms may be utilized to adjust the length of the strap. For example, the strap may include a Velcro® closure or a clasp including male and female connectors. As with support 12, strap 14 may be comprised of leather, fabric, plastic or any other flexible and/or elastic material, or a combination thereof.

Figure 3:
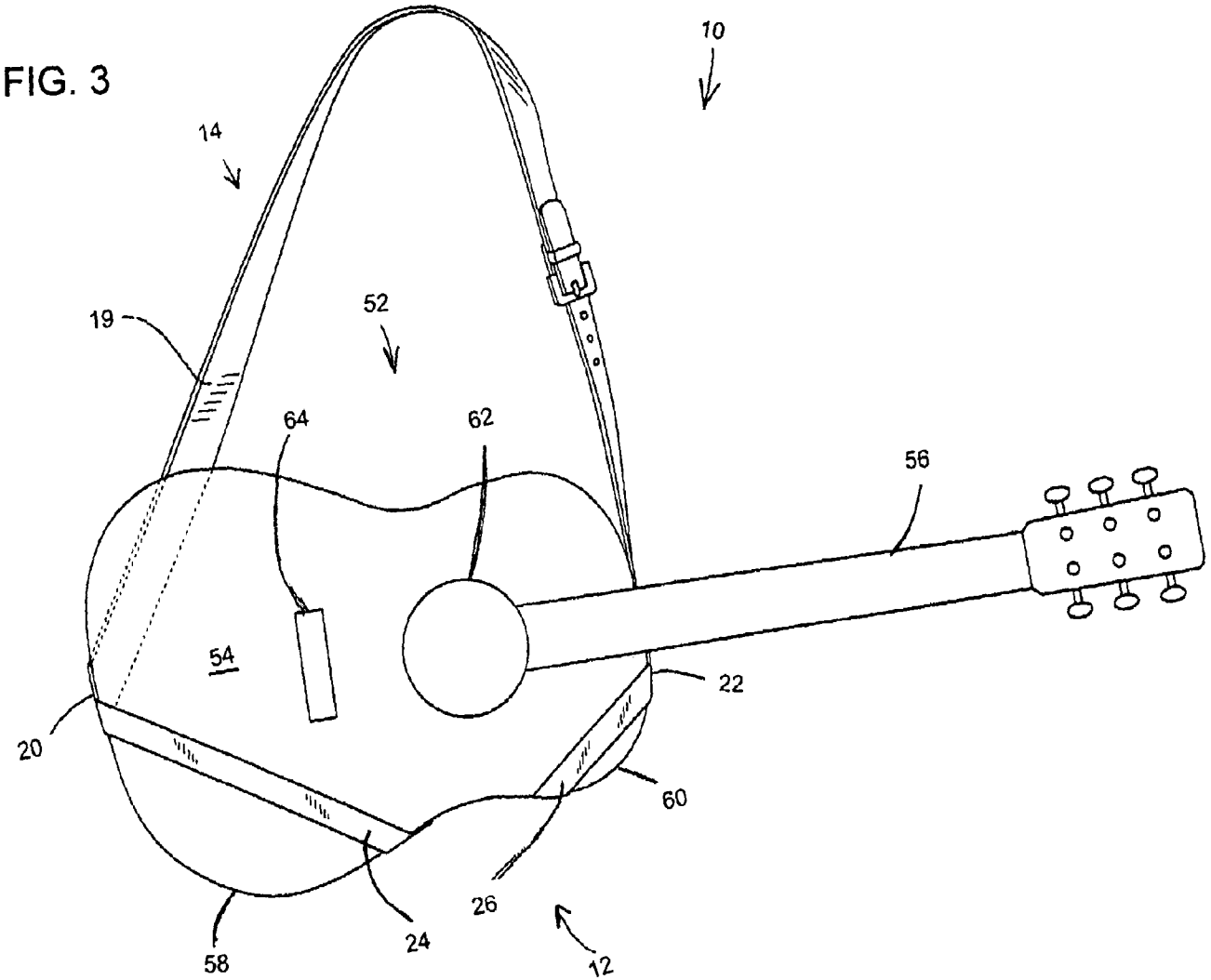
FIG. 3 is a perspective view of the musical instrument cradle of the present invention with a guitar supported therein.

FIGS. 2 and 3 also illustrate the inter-relationship of musical instrument cradle 10 and a musical instrument. In FIG. 2 that instrument is shown in phantom. Features of musical cradle 10 previously identified retain their prior numeration. The musical instrument illustrated in FIGS. 2 and 3 is a conventional guitar, 52, having a body 54 and a neck 56. Body 54 has an hour-glass configuration including bouts 58 and 60. Body 54 also includes a sound hole 62 and a bridge 64.

As shown in FIG. 2, strap 14 may be adjusted to a given length appropriate for the particular user using adjustment mechanism 48. Detachable end 42 is inserted through buckle 46 with the buckle tab inserted through the appropriate notch 44 to select the appropriate length. Strap 14 then may be positioned about the user. Alternatively, the strap may positioned about the user and then adjusted to the appropriate length. Preferably, strap 14 is positioned about the shoulder of the use; however, the strap also may be positioned about the user's neck or waist if desired.

Guitar 52 is placed in support 12 such that bout 58 rests in and is supported by loop 24. Similarly, guitar bout 60 rests in and is supported by loop 26. FIG. 3 illustrates cradle 10 with strap 14 adjusted to the appropriate length for the user and with guitar 52 secured within support 12. When guitar 52 is positioned in support 12, the weight of guitar 52 elongates loops 24 and 26 such that the loops conform to the size and shape of bouts 58 and 60. Where bands 16 and 18 are formed in whole or in part of an elastic material, an additional elastic force will be exerted by loops 16 and 18 on the mounted instrument. This additional force enables cradle 10 to retain the musical instrument in orientations away from the horizontal. For example, with sufficient elastic tension, the instrument may be played at an orientation approaching 90°.

With the simple figure-8 configuration, the present invention requires no fastening device to attach the strap to the musical instrument. As noted above, by "fastening device" it is meant any device which penetrates the heel or body of the guitar as well as any additional strap segments which extend about the musical instrument to retain it within the strap. By eliminating the use of a fastening device, a musical instrument may easily and quickly be positioned in and removed from the inventive strap.

While the cradle of the present invention eliminates the need for the use of fasteners, etc. in the body of the musical instrument, it should be appreciated that many musical instruments are manufactured with an end pin protruding from the bottom of the guitar body which is designed to hook onto a strap. If desired, the cradle of the present invention may be provided with a hole to hook onto the end pin for additional support and/or to prevent sliding of the strap.

Using cradle 10, the musical instrument is supported in a substantially horizontal position. The instrument may be supported in this manner while being used during practice or a performance. When the user is finished, the instrument simply is lifted from support 12. Cradle 10 then may be removed or if the user wishes to play another instrument, a different instrument may be positioned in support 12.

Figure 4:
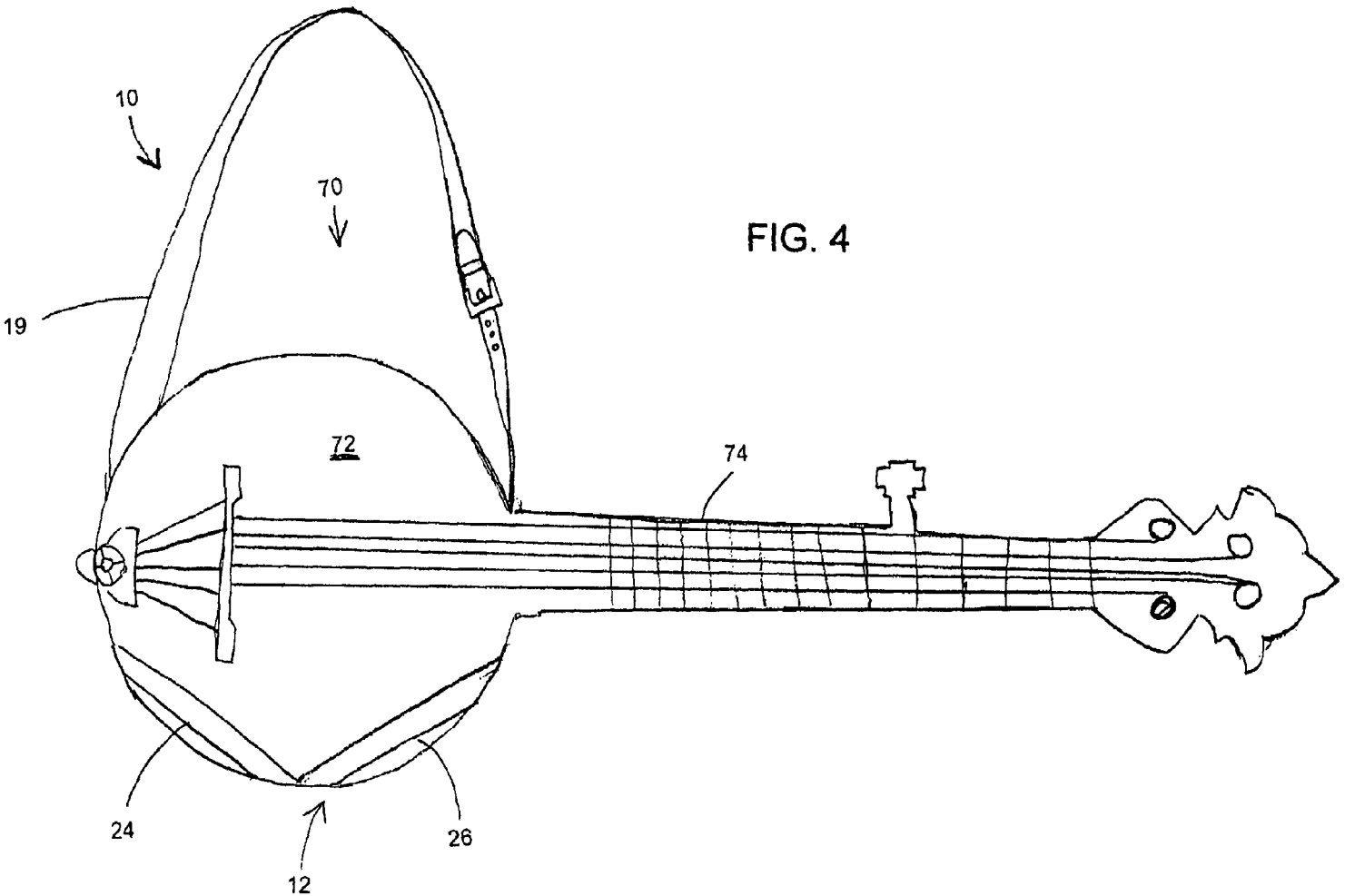
FIG. 4 is a perspective view of the musical instrument cradle of the present invention with a banjo supported therein.

Advantageously, cradle 10 may be used with any stringed musical instrument which the player carries generally horizontally and plays by plucking the strings. For example, FIG. 4 illustrates cradle 10 attached to a different musical instrument, namely, a banjo, 70. Banjo 70 includes a generally circular body, 72, and a neck, 74. When used with an instrument having this body shape, loops 24 and 26 of support 12 support body 72 as illustrated.

While the invention has been described with reference to a preferred embodiment, those skilled in the art will understand that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In this application all units are in the metric system and all amounts and percentages are by weight, unless otherwise expressly indicated. Also, all citations referred herein are expressly incorporated herein by reference.

The invention claimed is:

1. A cradle for a musical instrument, consisting essentially of:

(a) a support having a figure-8 configuration comprising a pair of loops adapted to support said musical instrument without the use of any fastening devices to the musical instrument; and (b) a strap having a pair of ends, each of which is connected to a loop of said support.

2. The musical instrument cradle of claim 1 wherein said support comprises a single band folded to form said loops of said figure-8 configuration.

3. The musical instrument cradle of claim 1 wherein said support further comprises an intersection between said pair of loops, said intersection being adjustable to define the relative size of said loops.

4. The musical instrument cradle of claim 1 wherein said support comprises a pair of bands which form said loops, said loops being connected together to form said figure-8 configuration.

5. The musical instrument cradle of claim 4 wherein said loops are releasably connected together.

6. The musical instrument cradle of claim 1 wherein said strap further comprises a buckle for adjusting the length of said strap.

7. The musical instrument cradle of claim 1 wherein said first and second ends are integrally formed with said support.

8. The musical instrument cradle of claim 1 wherein said first and second ends are secured to said support by stitching.

9. A method for supporting a musical instrument having a body, comprising the steps of:

(a) providing a musical instrument cradle consisting essentially of a support having a figure-8 configuration comprising a pair of loops adapted to support said musical instrument without the use of any fastening devices to the musical instrument and a strap having a pair of ends, each of which is connected to a loop of said support; and (b) positioning said musical instrument body within said cradle support with said loops cradling said musical instrument body, whereby said musical instrument body is supported in a substantially horizontal position by said loops.

* * * * *